US008469495B2

(12) United States Patent
Gerstenberger et al.

(10) Patent No.: US 8,469,495 B2
(45) Date of Patent: Jun. 25, 2013

(54) PRODUCING INK DROPS IN A PRINTING APPARATUS

(75) Inventors: Jeffrey S. Gerstenberger, Rochester, NY (US); Keith A. Hadley, Rochester, NY (US); Manh Tang, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 60 days.

(21) Appl. No.: 13/182,755

(22) Filed: Jul. 14, 2011

(65) Prior Publication Data

US 2013/0016145 A1 Jan. 17, 2013

(51) Int. Cl.
*B41J 2/07* (2006.01)
*B41J 2/12* (2006.01)
*B41J 2/02* (2006.01)

(52) U.S. Cl.
CPC ..... *B41J 2/02* (2013.01)
USPC ..... 347/74; 347/78

(58) Field of Classification Search
USPC ..... 347/74, 9, 10, 11, 12
See application file for complete search history.

(56) References Cited

U.S. PATENT DOCUMENTS 1,941,001 A 12/1933 Hansell
3,373,437 A 3/1968 Sweet et al.
4,310,845 A * 1/1982 Tsao ..... 347/79
6,079,821 A 6/2000 Chwalek et al.
6,243,109 B1 * 6/2001 Ishinaga et al. ..... 347/3
6,276,773 B1 * 8/2001 Takizawa ..... 347/10
6,419,339 B2 * 7/2002 Takahashi ..... 347/14
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,793,328 B2 9/2004 Jeanmaire
6,827,429 B2 12/2004 Jeanmaire et al.
6,851,796 B2 2/2005 Jeanmaire et al.
7,758,171 B2 7/2010 Brost
7,828,420 B2 11/2010 Fagerquist et al.
2004/0233243 A1 * 11/2004 Jeanmaire ..... 347/15
2006/0023011 A1 * 2/2006 Hawkins et al. ..... 347/12
2006/0071978 A1 * 4/2006 Steiner et al. ..... 347/55
2008/0143766 A1 * 6/2008 Hawkins et al. ..... 347/11
2008/0231669 A1 * 9/2008 Brost ..... 347/75

* cited by examiner

*Primary Examiner* — Julian Huffman
(74) *Attorney, Agent, or Firm* — Nelson Adrian Blish

(57) ABSTRACT

A method of producing ink drops (54, 56) in a printing apparatus (20) sends print-nonprint data from a controller (38) to at least one inkjet nozzle (28). The print-nonprint data includes data on a current ink drop and data on at least one previous ink drop. A set of waveforms (114, 116) is provided to the at least one nozzle and a waveform based on the print-nonprint data is selected. The selected waveform is supplied to an ink droplet formation device associated with the at least one nozzle and an ink drop is produced from the at least one nozzle.

7 Claims, 11 Drawing Sheets

PIXEL WAVEFORM SEQUENCES

| Previous Pixel | Non-print | Print | Print | Non-print |
|---|---|---|---|---|
| Current Pixel | Print | Print | Non-print | Non-print |
| Waveform 1 | Large A (114a) | Large D (114d) | Small A (116a) | Small D (116d) |
| Waveform 2 | Large B (114b) | Large B (114b) | Small B (116b) | Small D (116d) |
| Waveform 3 | Large C (114c) | Large C (114c) | Small C (116c) | Small D (116d) |

PIXEL WAVEFORM SEQUENCES

| Previous Pixel | Non-print | Print | Print | Non-print |
|---|---|---|---|---|
| Current Pixel | Print | Print | Non-print | Non-print |
| Waveform 1 | Large A (114a) | Large D (114d) | Small A (116a) | Small D (116d) |
| Waveform 2 | Large B (114b) | Large B (114b) | Small B (116b) | Small D (116d) |
| Waveform 3 | Large C (114c) | Large C (114c) | Small C (116c) | Small D (116d) |

FIG. 5

PIXEL WAVEFORM SEQUENCES

| Previous Pixel | Non-print | Print | Print | Non-print |
|---|---|---|---|---|
| Current Pixel | Print | Print | Non-print | Non-print |
| Waveform 1 | Large A (114a) | Large A (114a) | Small B (116b) | Small D (116d) |
| Waveform 2 | Large B (114b) | Large B (114b) | Small C (116c) | Small D (116d) |
| Waveform 3 | Large C (114c) | Large C (114c) | Small D (116d) | Small D (116d) |
| Waveform 4 | Small A (116a) | Small A (116a) | Small D (116d) | Small D (116d) |

FIG. 7

PIXEL WAVEFORM SEQUENCES

| Previous Pixel Length | 3 | 4 | 3 | 4 | 3 | 4 | 3 | 4 |
|---|---|---|---|---|---|---|---|---|
| Previous Pixel Type | Non-print | Non-print | Print | Print | Print | Print | Non-print | Non-print |
| Current Pixel Type | Print | Print | Print | Print | Non-print | Non-print | Non-print | Non-print |
| Waveform 1 | Large A | Large A | Large D | Large A | Small A | Small B | Small D | Small D |
| Waveform 2 | Large B | Large B | Large B | Large B | Small B | Small C | Small D | Small D |
| Waveform 3 | Large C | Large C | Large C | Large C | Small C | Small D | Small D | Small D |
| Waveform 4 | Small A | Small A | Small A | Small A | Small D | Small D | Small D | Small D |

FIG. 9

PRODUCING INK DROPS IN A PRINTING APPARATUS

FIELD OF THE INVENTION

The present invention relates to continuous inkjet printing in general and in particular to producing ink drops with a reduced set of waveforms.

BACKGROUND OF THE INVENTION

Traditionally, digitally controlled color inkjet printing is accomplished by one of two technologies. Both require independent ink supplies for each of the colors of ink provided. Ink is fed through channels formed in the printhead. Each channel includes a nozzle from which drops of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce, in general, up to several million shades or color combinations.

The first technology, commonly referred to as "drop on demand" inkjet printing, selectively provides ink drops for impact upon a recording surface using a pressurization actuator (thermal, piezoelectric, etc.). Selective activation of the actuator causes the formation and ejection of a flying ink drop that crosses the space between the printhead and the print media and strikes the print media. The formation of printed images is achieved by controlling the individual formation of ink drops, as required to create the desired image. Typically, a slight negative pressure within each channel keeps the ink from inadvertently escaping through the nozzle, and also forms a slightly concave meniscus at the nozzle helping to keep the nozzle clean.

Conventional drop on demand inkjet printers utilize a heat actuator or a piezoelectric actuator to produce the ink drop at orifices of a printhead. With heat actuators, a heater, placed at a convenient location, heats the ink to cause a localized quantity of ink to phase change into a gaseous steam bubble that raises the internal ink pressure sufficiently for an ink drop to be expelled. With piezoelectric actuators, a mechanical force causes an ink drop to be expelled.

The second technology, commonly referred to as "continuous stream" or simply "continuous" inkjet printing, uses a pressurized ink source that produces a continuous stream of ink drops. Traditionally, the ink drops are selectively electrically charged. Deflection electrodes direct those drops that have been charged along a flight path different from the flight path of the drops that have not been charged. Either the deflected or the non-deflected drops can be used to print on receiver media while the other drops go to an ink capturing mechanism (catcher, interceptor, gutter, etc.) to be recycled or disposed. U.S. Pat. No. 1,941,001 (Hansell) and U.S. Pat. No. 3,373,437 (Sweet et al.) each disclose an array of continuous inkjet nozzles wherein ink drops to be printed are selectively charged and deflected towards the recording medium.

In another form of continuous inkjet printing, such as is described in commonly-assigned U.S. Pat. No. 6,491,362 (Jeanmaire), included herein by reference, stimulation devices are associated with various nozzles of the printhead. These stimulation devices perturb the liquid streams emanating from the associated nozzle or nozzles in response to drop formation waveforms supplied to the stimulation devices by control means. The perturbations initiate the separation of a drop from the liquid stream. Different waveforms can be employed to create drops of a plurality of drop volumes. A controlled sequence of waveforms supplied to the stimulation device yields a sequence of drops, whose drop volumes are controlled by the waveforms used. A drop deflection means applies a force to the drops to cause the drop trajectories to separate based on the size of the drops. Some of the drop trajectories are allowed to strike the print media while others are intercepted by a catcher or gutter.

In this form of continuous inkjet printing, typically a printhead includes a large number of nozzles formed on a nozzle plate, with each nozzle having an associated stimulation device that is also formed on the nozzle plate. Since each stimulation device is typically activated by an independently controlled sequence of waveforms, a large number of electrical connections must be made between the stimulation devices on the nozzle plate and the drop formation mechanism control circuit that provides the sequences of waveforms. Typically the drop forming mechanism control circuitry is also formed on the nozzle plate to reduce the number of electrical connections that must be made to the nozzle plate. The drop forming mechanism control circuitry formed on the nozzle plate is typically formed using a CMOS process. The drop forming mechanism control circuit receives a set of waveforms and waveform selection control information from an image synchronization controller, which is typically located on a circuit board.

In this printing system, typically two volumes of drops are used, a small drop having a small drop volume and a large drop whose volume is approximately N times the small drop volume, where N is an integer. Small drops are formed by small drop waveforms having a period, called the small drop period. Large drops are formed by large drop waveforms having a large drop period equal to N times the small drop period. The small drop frequency, the inverse of the small drop period, serves as the base or fundamental frequency for drop formation. The base, or fundamental, drop creation rate or frequency is typically fixed, or at least cannot be varied widely. In some cases the base drop creation frequency is defined by a printing system clock or by a natural characteristic of the drop generator such as its resonant frequency.

As described in commonly assigned U.S. Pat. No. 7,828,420 (Fagerquist et al), the large drop waveform can include a number of activation pulses within the large drop period to improve the formation or coalescence time of the large drop, uniformity of drop velocity, and the drop-to-drop spacing. As discussed therein, the large drop waveform can influence the uniformity of drop velocity and drop-to-drop spacing for small drops formed after the large drop formed by the large drop waveform. While the large drop waveform can be designed to improve the drop velocity uniformity of subsequent small drops, it is useful to provide more than one small drop waveform: one small drop waveform for use when the preceding drop is a large drop and another small drop waveform for use when the preceding drop is a small drop. Similarly, it is desirable to provide more than one large drop waveform: one large drop waveform for use when the preceding drop is a large drop and another large drop waveform for use when the preceding drop is a small drop. As the small drop period serves as the basic time period for drop formation, it is useful to define the large drop waveforms as defined sequences of large drop sub-waveforms, where each large drop sub-waveform has a period equal to the small drop period.

As the base drop frequency is fixed, or at least cannot be varied widely, and since there are a plurality of small drop waveforms and large drop sub-waveforms, the traditional method of controlling the sequence of drops formed by each nozzle in the printhead has involved the image synchronization controller providing all of the small drop waveforms and large drop sub-waveforms along with waveform selection control signals to the drop forming mechanism control circuit during each base drop period. Providing all of the waveforms and waveform selection control signals from the image synchronization controller to the drop forming mechanism control circuit during each base drop period requires many interconnects between the image synchronization controller and the drop forming mechanism control circuit. For example, in one implementation, there are eight unique waveforms for a 512-nozzle segment of the nozzle plate. The control circuitry associated with each nozzle requires a 3-bit waveform selection control signal to select one of the eight waveforms. This results in a total of 1536 select bits to be sent to the nozzle plate segment during each base drop period. The printhead operates with a base drop frequency of 480 kHz, resulting in a required bandwidth of approximately 750 megabits/second for the select signals. To keep the data rate low enough for the CMOS process used to fabricate the nozzle plate, the interconnect between the image synchronization controller and the nozzle plate segment that carries the waveform selection signals must be at least 8 bits wide. When combined with clock, latch, and enable signals necessary to operate the nozzle plate segment, this results in a total of 19 interconnects to control the nozzle plate segment. It is desirable to minimize the number of interconnects to the nozzle plate to reduce manufacturing costs and improve reliability.

It is also desirable to minimize the drop forming mechanism control circuitry on the nozzle plate to improve manufacturing yield and increase the number of nozzle plates that can be produced from one silicon wafer, thereby reducing the manufacturing cost.

SUMMARY OF THE INVENTION

Briefly, according to one aspect of the present invention a method of producing ink drops in a printing apparatus sends print-nonprint data from a controller to at least one inkjet nozzle. The print-nonprint data includes data on a current ink drop and data on at least one previous ink drop. A set of waveforms is provided to the at least one nozzle and a waveform based on the print-nonprint data is selected. The selected waveform is supplied to an ink droplet formation device associated with the at least one nozzle and an ink drop is produced from the at least one nozzle.

According to a feature of the present invention, the number of waveforms in the set of waveforms supplied by the controller to the nozzle plate is reduced without limiting the ability of the drop forming device to produce different types of drops. This reduction in the number of supplied waveforms reduces the number of interconnects to the printhead, reducing manufacturing cost and improving reliability.

According to another feature of the present invention, the number of waveform selection signals supplied by the controller to the nozzle plate and the frequency with which the selection signals are supplied are reduced. This reduction in the amount of supplied waveform selection data further reduces the number of interconnects to the nozzle plate.

According to yet another feature of the present invention, the amount of control circuitry to load and latch the waveform selection signals, distribute the waveforms to the drop forming devices and select the appropriate waveform for each drop forming device is reduced. If the control circuitry is implemented on the silicon substrate of the printhead, the reduction in control circuitry may improve nozzle plate manufacturing yield as well as increase the number of nozzle plates that can be produced from a silicon wafer.

The invention and its objects and advantages will become more apparent in the detailed description of the preferred embodiment presented below.

BRIEF DESCRIPTION OF THE DRAWINGS

FIG. 5 is a table of pixel waveform sequences when there are three base drop periods per pixel.

FIG. 7 is a table of pixel waveform sequences when there are four base drop periods per pixel.

FIG. 9 is a table of pixel waveform sequences when the number of base drop periods per pixel varies between three and four.

DETAILED DESCRIPTION OF THE INVENTION

Figure 1:
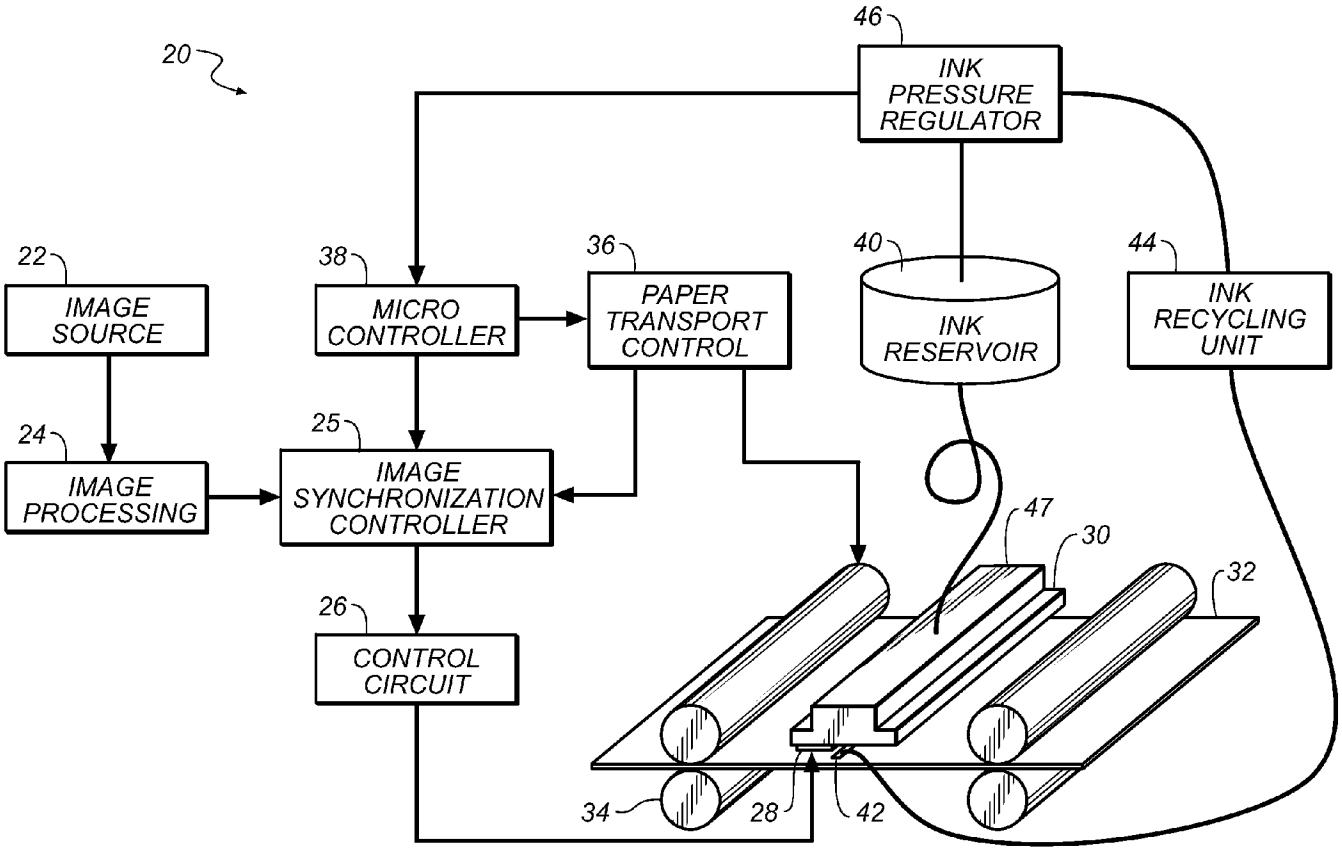
FIG. 1 shows a simplified block schematic diagram of an example embodiment of a printer system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous inkjet printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. An image synchronization controller 25 receives data from the image memory and synchronization signals for the paper transport control 36 to align the image data with the movement of the recording medium 32. The drop forming mechanism control circuit 26 receives the synchronized image data from image synchronization controller 25 and applies time-varying electrical pulses to the drop forming mechanism(s) 28 that are associated with one or more nozzles of a printhead 30. These pulses are applied at an appropriate time, and to the appropriate nozzle, so that drops formed from a continuous inkjet stream will form spots on a recording medium 32 in the appropriate position designated by the data in the image memory.

Recording medium 32 is moved relative to printhead 30 by a recording medium transport system 34, which is electronically controlled by a paper transport control 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous inkjet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46.

The ink is distributed to printhead 30 through an ink channel 47. The ink preferably flows through slots or holes etched through a silicon substrate, also commonly called a nozzle plate, of printhead 30 to its front surface, where a plurality of nozzles and drop forming mechanisms, for example, heaters, are situated. When the nozzle plate of the printhead 30 is fabricated from silicon, the drop forming mechanism control circuit 26 can be integrated with the printhead. Printhead 30 also includes a deflection mechanism (not shown in FIG. 1) which is described in more detail below with reference to FIGS. 2 and 3.

Figure 2:
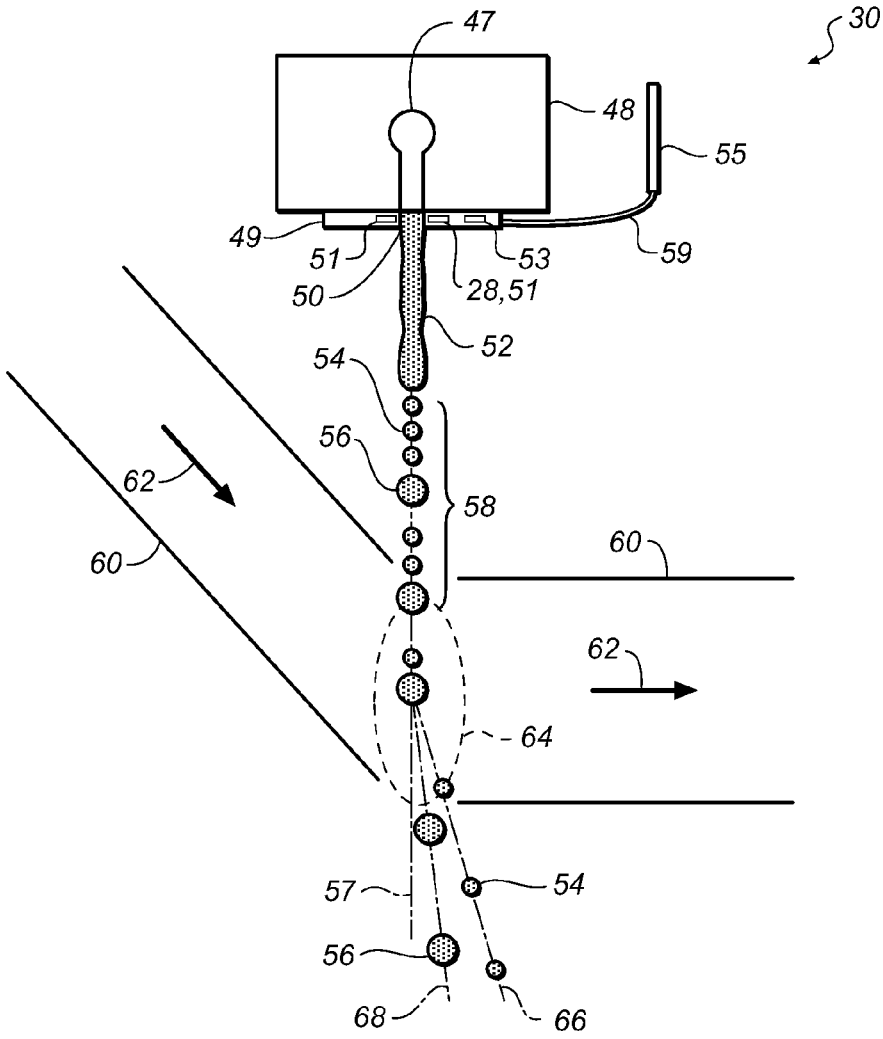
FIG. 2 is a schematic view of an example embodiment of a continuous printhead made in accordance with the present invention.

Referring to FIG. 2, a schematic view of a continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, if preferred, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure and preferably the nozzle array is a linear array of nozzles.

Jetting module 48 is operable to form liquid drops having a first size and liquid drops having a second size through each nozzle. To accomplish this, jetting module 48 includes a drop stimulation or drop forming device or transducer 28, for example, a heater, piezoelectric transducer, EHD transducer, or a MEMS actuator, that, when selectively activated, perturbs each filament of liquid 52, for example, ink, to induce portions of each filament to break off from the filament and coalesce to form drops 54, 56.

In FIG. 2, drop forming device 28 is a heater 51 located in a nozzle plate 49 on one or both sides of nozzle 50. This type of drop formation is known and has been described in, for example, U.S. Pat. Nos. 6,457,807 (Hawkins et al.); 6,491,362 (Jeanmaire); 6,505,921 (Chwalek et al.); 6,554,410 (Jeanmaire et al.); 6,575,566 (Jeanmaire et al.); 6,588,888 (Jeanmaire et al.); 6,793,328 (Jeanmaire); 6,827,429 (Jeanmaire et al.); and 6,851,796 (Jeanmaire et al.).

Typically, one drop forming device 28 is associated with each nozzle 50 of the nozzle array. However, a drop forming device 28 can be associated with groups of nozzles 50 or all of nozzles 50 of the nozzle array. When the drop forming device(s) is integrated into nozzle plate 49, which is fabricated from silicon, a portion of the drop forming mechanism control circuit 26 can be integrated with the nozzle plate. This portion of the drop forming mechanism control circuit is referred to as nozzle plate control circuit 53. Other portions of the drop forming mechanism control circuit, as well as the image synchronization controller 25, can reside on a separate circuit board that is also part of the printhead. These are referred to as jetting module electronics 55. The nozzle plate control circuit 53 is connected to the jetting module electronics 55 by means of an interconnect 59.

When printhead 30 is in operation, drops 54, 56 are typically created in a plurality of sizes, for example, in the form of large drops 56, a first size, and small drops 54, a second size. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the un-deflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that ink catcher 42 (shown in FIG. 3) can be positioned to intercept the small drop trajectory 66 so that drops following this trajectory are collected by ink catcher 42 while drops following the other trajectory bypass the catcher and impinge a recording medium 32 (shown in FIG. 3).

When ink catcher 42 is positioned to intercept small drop trajectory 66, large drops 56 are deflected sufficiently to avoid contact with ink catcher 42 and strike the print media. When ink catcher 42 is positioned to intercept small drop trajectory 66, large drops 56 are the drops that print, and this is referred to as large drop print mode.

Jetting module 48 includes an array or a plurality of nozzles 50. Liquid, for example, ink, supplied through ink channel 47, is emitted under pressure through each nozzle 50 of the array to form filaments of liquid 52. In FIG. 2, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Figure 3:
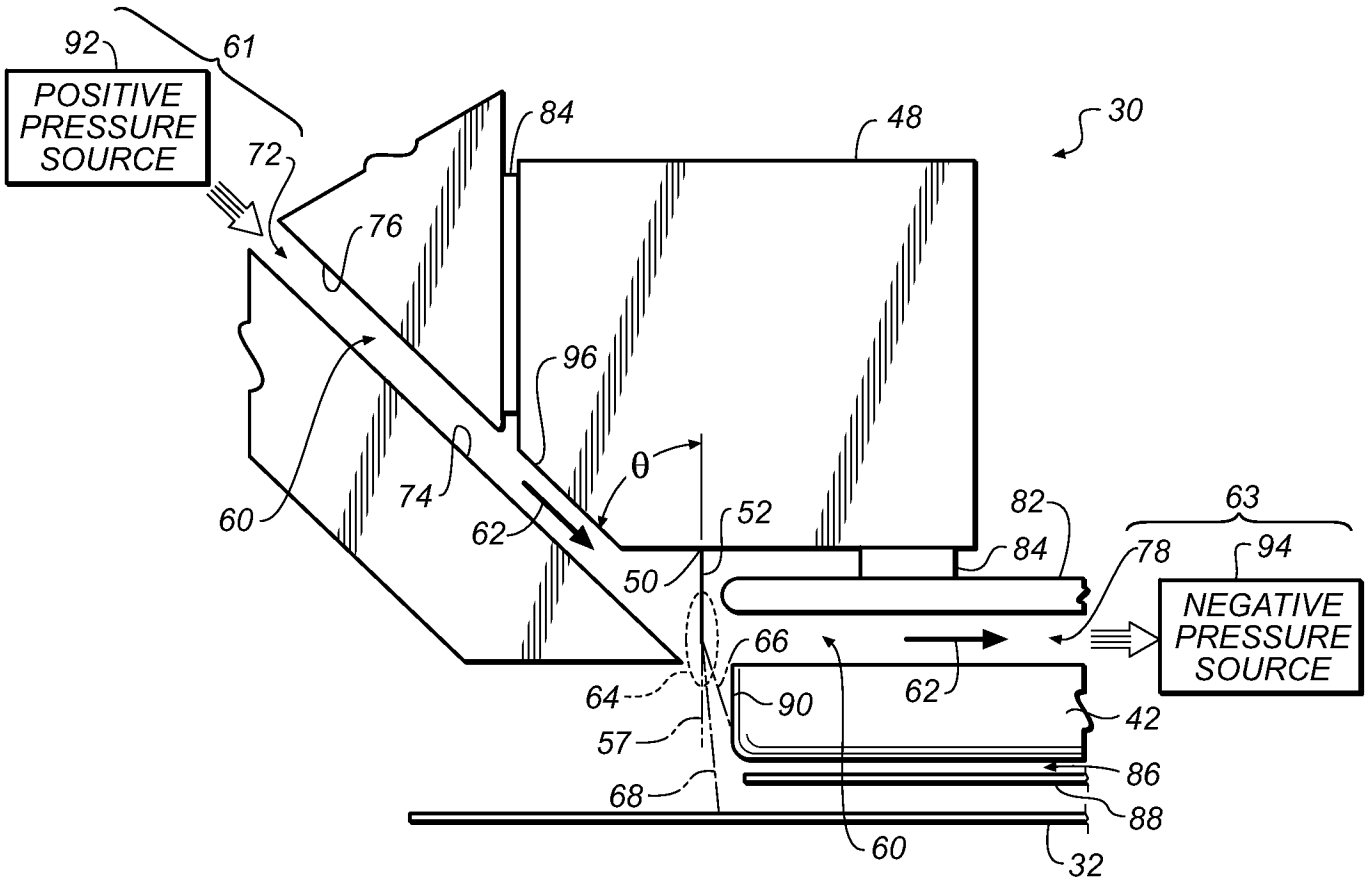
FIG. 3 is a schematic view of a simplified gas flow deflection mechanism of the present invention.

Referring to FIGS. 2 and 3, positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 3). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of ink catcher 42. Small drops 54 contact face 90 and flow down face 90 and into a liquid return duct 86 located or formed between ink catcher 42 and a plate 88. Collected liquid is either recycled and returned to ink reservoir 40 (shown in FIG. 1) for reuse or discarded. Large drops 56 bypass ink catcher 42 and travel on to recording medium 32. Alternatively, ink catcher 42 can be positioned to intercept large drop trajectory 68. Large drops 56 contact ink catcher 42 and flow into a liquid return duct located or formed in ink catcher 42. Collected liquid is either recycled for reuse or discarded. Small drops 54 bypass ink catcher 42 and travel on to recording medium 32.

Referring to FIG. 2, alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821 (Chwalek et al.).

Figure 4:
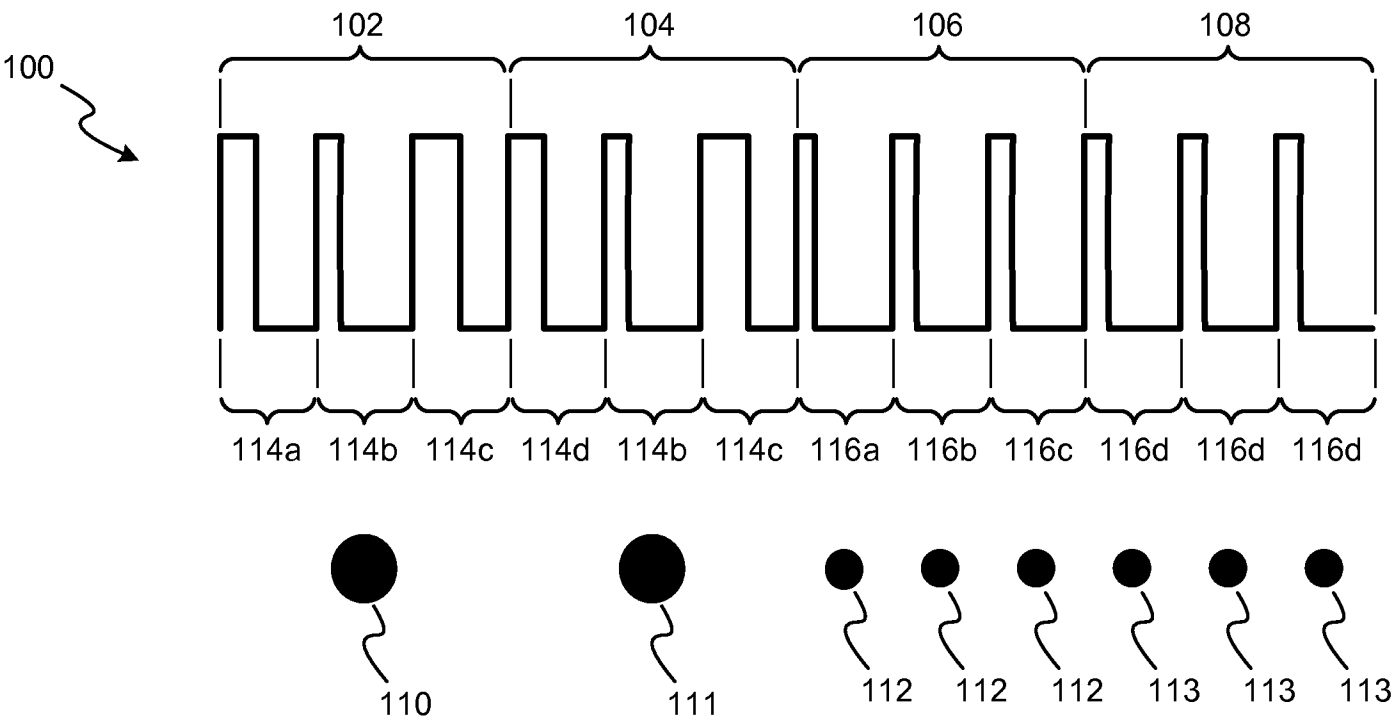
FIG. 4 is a plot of waveform and drop sequences for print and non-print pixels when there are three base drop periods per pixel.

Referring to FIG. 4, there is shown a sequence of waveforms 100 for the creation of a sequence of drops from a nozzle. The waveform sequence 100 shows the waveforms used to create drops for a sequence of four pixels: a first print pixel 102, a second print pixel 104, a first non-print pixel 106, and a second non-print pixel 108. The drops resulting from the waveform sequence 100 are shown as large print drops 110 and 111 and small non-print drops 112 and 113. The waveform sequence shows the case when the print speed is such that the number of base drop periods per pixel is three and the volume ratio of large print drops to small non-print drops is three. The waveform sequence assumes that the pixel preceding the first print pixel 102 is a non-print pixel.

Since there are three base drop periods per pixel in the waveform sequence 100, there are three waveforms per pixel. The first print pixel 102 is comprised of waveforms 114*a*, 114*b* and 114*c*. These waveforms act together to form a single large print drop 110. Similarly, the second print pixel 104 is comprised of waveforms 114*d*, 114*b* and 114*c* which result in a single large print drop 111. The waveform sequence for the second print pixel 104 is distinguished from the waveform sequence for the first print pixel 102 due to changes in the desired activation pattern of the drop forming device 28 required to account for the second large print drop 111 following immediately after the first large print drop 110 and being affected by that preceding large drop. The first non-print pixel 106 is comprised of waveforms 116*a*, 116*b* and 116*c*. These waveforms are distinguished from each other due to the variations in the activation pattern of the drop forming device 28 necessary to ensure the three drops remain separate as they follow the preceding large print drop 111. The second non-print pixel 108 is composed of waveform 116*d* repeated three times. The waveform sequence for the second non-print pixel 108 is distinguished from the waveform sequence for the first non-print pixel 106 due to changes in the desired activation pattern of the drop forming device 28 because the first small non-print drops 112 are following large print drop 111 and are affected by the preceding large drop as they travel from the nozzle 50 to the recording medium 32. After the first non-print pixel 106 completes, the effects of large print drop 111 have dissipated and the second non-print pixel 108 is composed by repeating the steady-state waveform 116*d*.

The number and relative size of the stimulus pulses in waveforms 114*a*-114*d* and 116*a*-116*d* in FIG. 4 are shown for illustrative purposes only. The duration and number of stimulus pulses in each waveform may vary in order to improve drop formation, drop spacing, reduce satellite drops, or otherwise improve print quality. Such variations are understood to be within the scope of the invention.

FIG. 4 shows that there are four possible waveform sequences which correspond to combinations of print and non-print pixels. These sequences are: a printing pixel preceded by a non-printing pixel, as shown in first printing pixel 102, a printing pixel preceded by another printing pixel, as shown in second printing pixel 104, a non-printing pixel preceded by a printing pixel, as shown in first non-printing pixel 106, and a non-printing pixel preceded by another non-printing pixel, as shown in second non-printing pixel 108. As each line of pixels is printed by printhead 30, one of these four waveform sequences is selectively used to activate each drop forming device 28 to create the desired pattern of small non-print drops and large print drops. The table in FIG. 5 shows the waveform sequences for each of the four combinations of print and non-print pixels.

Figure 6:
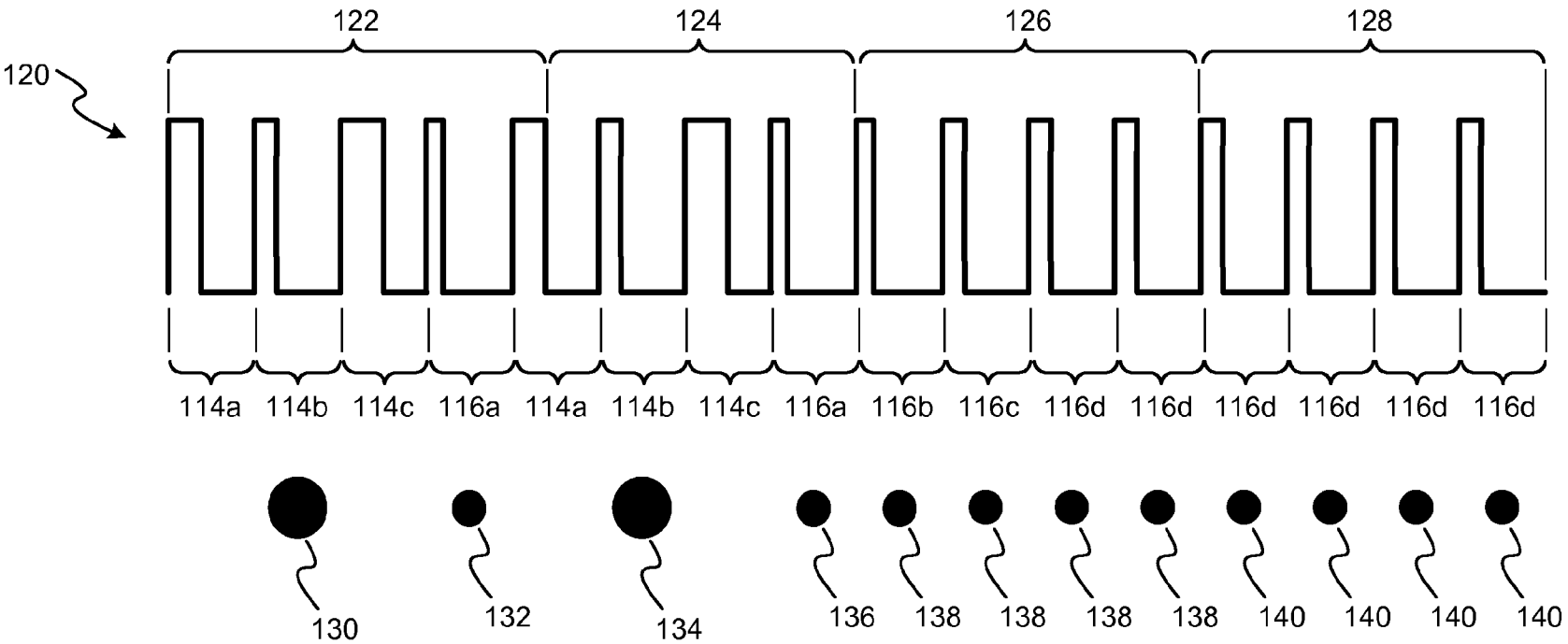
FIG. 6 is a plot of waveform and drop sequences for print and non-print pixels when there are four base drop periods per pixel.

Referring to FIG. 6, there is shown a sequence of waveforms 120 for the creation of a sequence of drops from a nozzle for the case when the print speed is such that the number of base drop periods per pixel is four and the ratio of large print drops to small non-print drops is three. The waveform sequence 120 shows the waveforms used to create drops for a sequence of four pixels: a first print pixel 122, a second print pixel 124, a first non-print pixel 126, and a second non-print pixel 128. The drops resulting from the waveform sequence 100 are shown as large print drops 130 and 134 and small non-print drops 132, 136, 138 and 140. The waveform sequence assumes that the pixel preceding the first print pixel 122 is a non-print pixel.

Since there are four base drop periods per pixel in the waveform sequence 120, there are four waveforms per pixel. The first print pixel 122 is comprised of waveforms 114*a*, 114*b*, 114*c* and 116*a*. These waveforms are distinguished from each other due to the variations in the activation pattern of the drop forming device 28 necessary to form a single large print drop 130 and to cause the creation of a separate small non-print drop 132. Similarly, the second print pixel 124 is comprised of waveforms 114*a*, 114*b*, 114*c* and 116*a* which result in forming a single large print drop 134 and a separate small non-print drop 136. In this case, the waveform sequence for the second print pixel 124 is the same as the waveform sequence for the first print pixel 122 since, in both cases, the large print drop is following a small non-print drop.

The first non-print pixel 126 is comprised of waveforms 116*b*, 116*c*, 116*d* and 116*d*. These waveforms are distinguished from each other due to the variations in the activation pattern of the drop forming device 28 necessary to cause the four drops to remain separate as they follow the preceding large print drop 134. The second non-print pixel 128 is composed of waveform 116*d* repeated four times. The waveform sequence for the second non-print pixel 128 is distinguished from the waveform sequence for the first non-print pixel 126 due to changes in the desired activation pattern of the drop forming device 28 because the first small non-print drops 138 are following large print drop 134 and are affected by the preceding large drop as they travel from the nozzle 50 to the recording medium 32. After the first non-print pixel 126 completes, the effects of large print drop 134 have dissipated and the second non-print pixel 128 is composed by repeating the steady-state waveform 116*d*.

The number and relative size of the stimulus pulses in waveforms 114*a*-114*d* and 116*a*-116*d* in FIG. 6 are shown for illustrative purposes only. Furthermore, while the waveforms 114*a*-114*d* and 116*a*-116*d* in FIG. 6 are shown to be the same as the waveforms shown in FIG. 4, they may be different. The duration and number of stimulus pulses in each waveform may vary in order to improve drop formation, drop spacing, reduce satellite drops or otherwise improve print quality. Such variations are understood to be within the scope of the invention.

As in FIG. 4, FIG. 6 shows that there are four possible waveform sequences which correspond to combinations of print and non-print pixels. As each line of pixels is printed by printhead 30, each of the plurality of nozzles 50 will use one of these four waveform sequences to activate the drop forming device 28 to create the desired pattern of small non-print drops and large print drops. The table in FIG. 7 shows the waveform sequences for each of the four combinations of print and non-print pixels.

Figure 8:
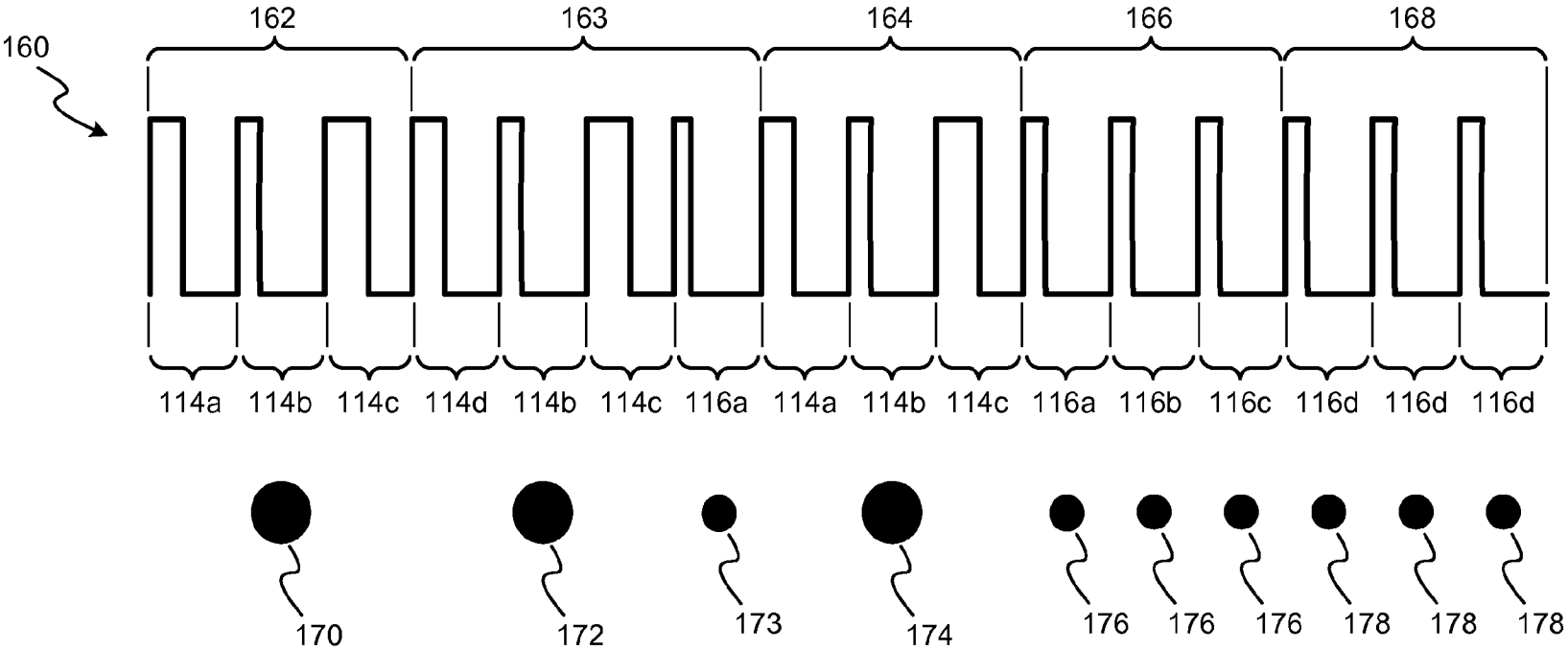
FIG. 8 is a plot of waveform and drop sequences for print and non-print pixels when the number of base drop periods per pixel varies between three and four.

The printing system 20 needs to be able to print at multiple speeds, not just at those print speeds at which there are a constant integer number of base drop periods per pixel. At such intermediate print speeds, the time between successive print drops is not fixed. For example, the number of base drop periods per pixel may be three for some of pixels, while other pixels have four base drop periods per pixel. FIG. 8 illustrates a waveform sequence for five pixels in which the pixels have a length of three base drop periods per pixel, except for the second pixel, which has a length of four base drop periods. The waveform sequence 160 shows the waveforms used to create drops for the five pixels: a first print pixel 162, a second print pixel 163, a third print pixel 164, a first non-print pixel 166, and a second non-print pixel 168. The drops resulting from the waveform sequence 160 are shown as large print drops 170, 172 and 174 and small non-print drops 173, 176 and 178. The waveform sequence assumes that the pixel preceding the first print pixel 162 is a non-print pixel.

In FIG. 8, there are three waveforms per pixel for the first, third, fourth and fifth pixels, and four waveforms for the second pixel. The length of the waveform sequence for the second pixel includes one additional waveform, which produces a small non-print drop 173, to accommodate a slightly slower print speed than shown in FIG. 4. The determination of which pixel(s) require additional base drops is made by image synchronization controller 25, based on synchronization signals received from paper transport control 36. The synchronization controller 25 inserts additional base drop periods as required to keep large print drops aligned with the movement of the recording medium 32.

When an additional base drop period is added to a pixel, the waveforms of the following pixel may be altered. Referring to FIG. 8, this is shown in the second print pixel 163 and third print pixel 164. For both pixels, the preceding pixel was a print pixel, but the waveform sequence differs. The second print pixel 163 is comprised of waveforms 114*d*, 114*b*, 114*c* and 116*a*, with waveforms 114*d*, 114*b* and 114*c* forming the large print drop 172. The third print pixel 164 is comprised of waveforms 114*a*, 114*b* and 114*c* which together form the large print drop 174. The waveform sequence for large print drop 174 differs from the waveform sequence for large print drop 172 due to the intervening small non-print drop 173 inserted at the end of the second print pixel 163.

FIG. 9 shows an expanded table of waveform sequences for combinations of print and non-print pixels and whether the preceding pixel was three or four base drop periods in length. For pixels in which only three base drop periods are needed, the fourth waveform in the table is skipped. While the table shows eight possible waveform sequences, only four of them are applicable during the printing of any given row of pixels, since for the preceding row of pixels, all of the pixels would have been printed with either three or four base drop periods.

The preceding examples have shown four waveforms used for generating large print drops and four waveforms used for generating small non-print drops. Implementations using a greater or fewer number of waveforms for either large print drops or small non-print drops are understood to be within the scope of the invention. Similarly, implementations that use fewer than three or more than four base drop periods per pixel are also understood to be within the scope of the invention.

Figure 10:
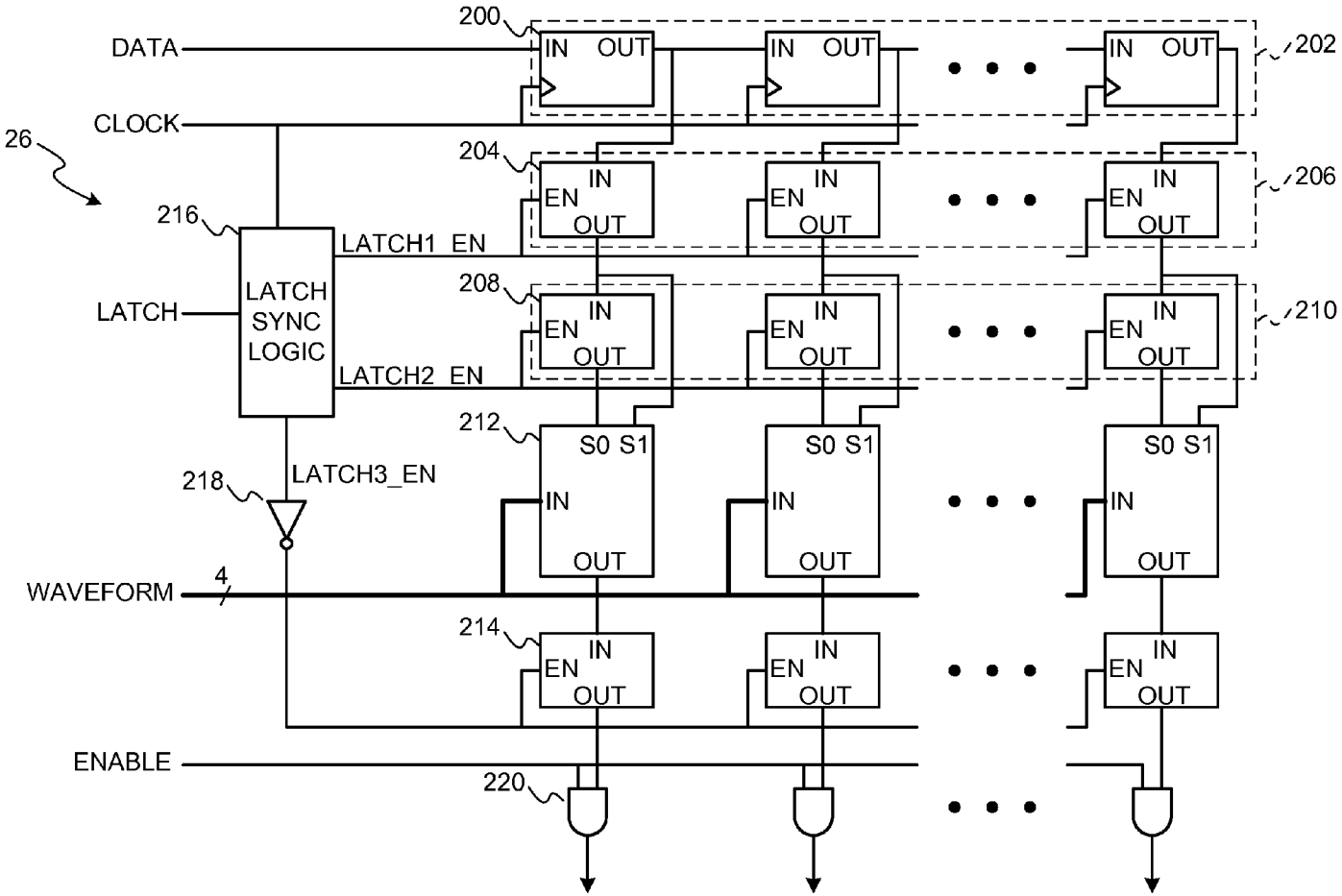
FIG. 10 is a schematic view of a drop forming mechanism control circuit.

Referring to FIG. 10, drop forming mechanism control circuit 26 is shown. The DATA, CLOCK, LATCH, WAVEFORM and ENABLE signals are inputs to the control circuit generated by image synchronization controller 25, which may be a microprocessor, application-specific integrated circuit, field programmable gate array, or similar device. Image data, consisting of print/non-print values, is provided via the DATA signal which drives the input to shift register bit 200, the first element of the array of shift register bits 202. The number of elements, N, in shift register 202 corresponds to the number of nozzles 50 in nozzle plate 49. Image data is serially loaded into shift register bit 200 and subsequently shifted into successive shift register bits according to the CLOCK signal from image synchronization controller 25. After N clock pulses of the CLOCK signal, shift register 202 holds the complete set of print/non-print data for the pixels in the next print line.

Figure 11:
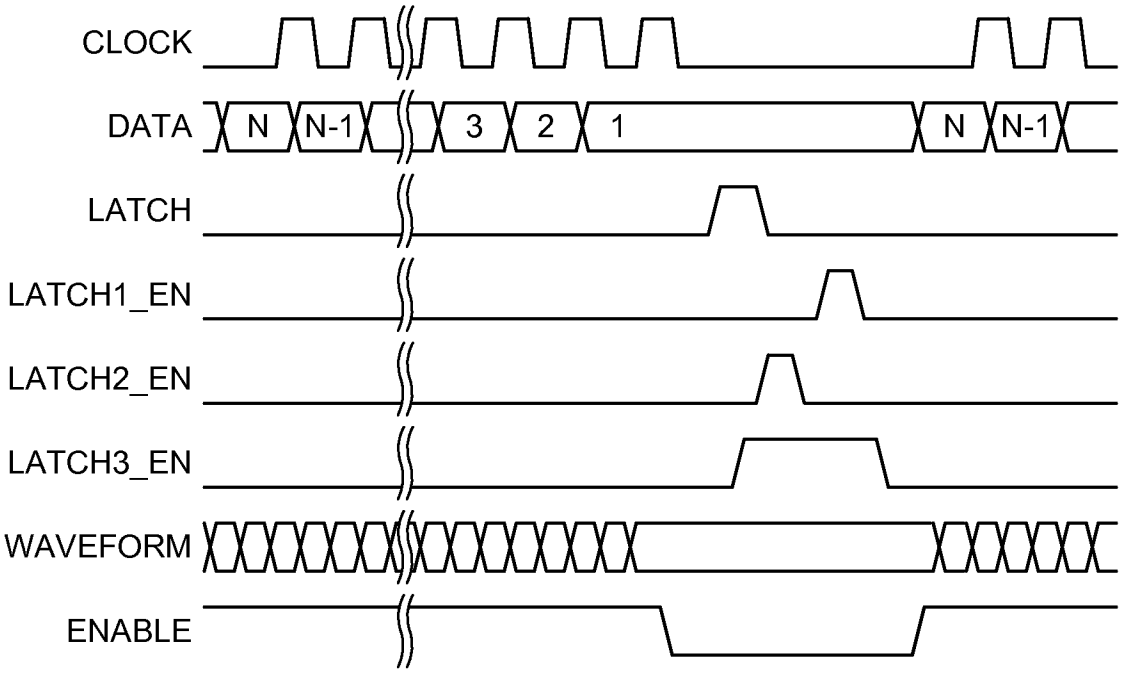
FIG. 11 is a timing diagram illustrating the operation of a drop forming mechanism control circuit.

Once shift register 202 is loaded with the print/non-print data for the next print line and image synchronization controller 25 receives an indication from paper transport control 36 that recording medium 32 is in position to receive the next line of image data, image synchronization controller 25 pulses the LATCH signal. The LATCH pulse causes first latch bit 204, the first element in the array of current line latch 206, to store the contents of first register bit 200. There are N elements in current line latch 206, and each bit is loaded from the corresponding bit in shift register 202. The LATCH pulse also causes first latch bit 208, the first element in the array of previous line latch 210, to store the contents of first latch bit 204. There are N elements in previous line latch 210, and each bit is loaded from the corresponding bit in current line latch 206. Latch synchronization logic 216 receives the LATCH input from image synchronization controller 25 and produces the LATCH1_EN and LATCH2_EN signals such that the previous line latch 210 captures the data stored in current line latch 206 before the current line latch 206 captures the data stored in shift register 202. This timing sequence is illustrated in FIG. 11.

After image synchronization controller 25 pulses the LATCH signal, the print/non-print data for the current line and previous line of the image is stored in current line latch 206 and previous line latch 210 respectively. The outputs of first latch bits 204 and 208 are used as selector inputs for 4-to-1 multiplexer 212. Multiplexer 212 uses these selector inputs to select one of the four WAVEFORM signals to pass through to the output of the multiplexer. The four WAVEFORM input signals from image synchronization controller 25 are the set of pixel waveform sequences, such as described in FIGS. 5, 7 and 9. There are N 4-to-1 multiplexers, with one multiplexer associated with each nozzle of nozzle plate 49.

The output of multiplexer 212 passes through latch bit 214 which is controlled by latch synchronization logic 216. Latch bit 214, the first element of an array of N latch bits, is operated such that the output of multiplexer 214 is stored while current line latch 206 and previous line latch 210 are being updated. Once the current line latch 206 and previous line latch 210 have been updated, latch bit 214 is returned to its transparent state. This operation ensures that no spurious transitions occur on the output while current line latch 206 and previous line latch 210 are being updated. Latch bit 214 is controlled by the LATCH3_EN signal generated by latch synchronization logic 216 and inverter 218. The timing sequence for the LATCH3_EN signal is illustrated in FIG. 11.

The output of latch bit 214 is combined with the ENABLE signal from image synchronization controller 25 in AND gate 220. The output of AND gate 220 is connected to drop forming device 28. There are N AND gates, with one AND gate associated with each nozzle of nozzle plate 49. The ENABLE signal provides a global means to disable all outputs of drop forming mechanism control circuit 26.

Line latches 206 and 210 enable image synchronization controller 25 to load the next line of image data into shift register 202 at the same time that image synchronization controller 25 is providing the pixel waveform sequences to print the current line of image data. This operation is illustrated in FIG. 11.

The circuit shown in FIG. 10 is one embodiment of a drop forming mechanism control circuit, and those skilled in the art will understand that other embodiments are possible. For example, the latch synchronization logic could be implemented as a synchronous state machine, the current and previous line latches could be implemented using registers, the interface could be expanded to support the loading of more than one image data bit per clock pulse, or the interface could be expanded to support more lines of print/non-print data used to select from more waveforms. These and similar variations are understood to be within the scope of the invention.

The drop forming mechanism control circuit shown in FIG. 10 has been described as having N elements of shift register bits, latches, multiplexers, and AND gates, where N is the number of nozzles in the nozzle plate. In an alternative embodiment of the invention, the nozzle plate may be divided into segments of nozzles, with each segment having an independent drop forming mechanism control circuit. For example, a nozzle plate with 2560 nozzles may be divided into five segments of 512 nozzles each. Dividing the nozzle plate into segments may be done to reduce timing delays or to improve the manufacturing process for the nozzle plate. Those skilled in the art will understand that using multiple segments in a nozzle plate is within the scope of the invention.

As discussed in U.S. Pat. No. 7,758,171 (Brost), the print quality can be improved by employing a phase shift or stagger in the data between adjacent nozzles. When employing such a phase shift or stagger, it can also be advantageous to employ different sets of waveforms, one set for the odd numbered nozzles and one set for the even numbered nozzles. The architecture discussed herein can accommodate such odd-even waveform differentiation by providing the two sets of waveform inputs to the drop forming mechanism control circuit. The multiplexers associated with the odd nozzles would then use the current and previous line data to select one waveform from the odd set of waveforms, while the multiplexers associated with the even nozzles would use the current and previous line data to select one waveform from the even set of waveforms. In addition, it may be desirable to separate the shift register, current line latch and previous line latch into odd and even components with separate data, clock, and latch control interfaces. The use of multiple sets of waveforms to introduce a phase shift between nozzles or otherwise improve print quality is understood to be within the scope of the invention.

The invention has been described in detail with particular reference to certain preferred embodiments thereof, but it will be understood that variations and modifications can be effected within the scope of the invention.

PARTS LIST

20 continuous printer system
22 image source
24 image processing unit
25 image synchronization controller
26 drop forming mechanism control circuit
28 drop forming device
30 printhead
32 recording medium
34 recording medium transport system
36 paper transport control
38 micro-controller
40 ink reservoir
42 ink catcher
44 ink recycling unit
46 ink pressure regulator
47 ink channel
48 jetting module
49 nozzle plate
50 plurality of nozzles
51 heater
52 liquid
53 nozzle plate control circuit
54 drops
55 jetting module electronics
56 drops
57 trajectory

58 drop stream
59 interconnect
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
84 seal
86 liquid return duct
88 plate
90 front face
92 positive pressure source
94 negative pressure source
96 wall
100 waveform sequence
102 first print pixel
104 second print pixel
106 first non-print pixel
108 second non-print pixel
110 large drop
111 large drop
112 small drop
113 small drop
**114*a*-114*d*** waveforms for large drop
**116*a*-116*d*** waveforms for small drop
120 waveform sequence
122 first print pixel
124 second print pixel
126 first non-print pixel
128 second non-print pixel
130 large drop
132 small drop
134 large drop
136 small drop
138 small drop
140 small drop
160 waveform sequence
162 first print pixel
163 second print pixel
164 third print pixel
166 first non-print pixel
168 second non-print pixel
170 large drop
172 large drop
173 small drop
174 large drop
176 small drop
178 small drop
200 shift register bit
202 shift register
204 latch bit
206 current line latch
208 latch bit
210 previous line latch
212 4-to-1 multiplexer
214 latch bit
216 latch synchronization logic
218 inverter
220 AND gate

The invention claimed is:

1. A method of producing ink drops in a printing apparatus comprising:

providing a set of waveform sequences to a control circuit associated with at least one nozzle, the set of waveform sequences including at least one waveform sequence for the creating one or more print drops and at least one waveform sequence for creating one or more non-print drops;

sending print-nonprint pixel data from a controller to a control circuit associated with the at least one inkjet nozzle;

wherein the print-nonprint pixel data includes data on a current pixel and data on at least one previous pixel;

selecting a waveform from the set of waveforms based on the print-nonprint pixel data;

supplying the selected waveform to an ink drop formation device associated with the at least one nozzle; and producing an ink drop from the at least one nozzle.

2. The method of claim 1 wherein the set of waveform sequences is sent simultaneously to the control circuits associated with a plurality of nozzles.

3. The method of claim 2 wherein the plurality of nozzles are grouped into subgroups wherein the provided set of waveforms is different for each subgroup.

4. The method of claim 1 wherein the length of all waveforms in the provided set of waveforms are identical.

5. The method of claim 1 wherein the length of a first provided set of waveforms varies from a length of a second provided set of waveforms.

6. The method of claim 1 wherein the length of all waveforms provided in the set of waveforms are identical and vary with the number of small drop periods during the period of a pixel.

7. The method of claim 1 wherein the waveforms are stored in electronics on a nozzle plate.

* * * * *